US005796075A

United States Patent [19]

Gross et al.

[11] Patent Number: 5,796,075

[45] Date of Patent: Aug. 18, 1998

[54] HEATER, PARTICULARLY FOR KITCHEN APPLIANCES

[75] Inventors: Martin Gross, Kampfelbach; Werner Renz, Sternenfels, both of Germany

[73] Assignee: E.G.O. Elektro-Gerate Blanc und Fisher GmbH & Co. KG, Oberderdingen, Germany

[21] Appl. No.: 604,819

[22] Filed: Feb. 23, 1996

Related U.S. Application Data

[63] Continuation-in-part of Ser. No. 117,519, Sep. 3, 1993, Pat. No. 5,498,853.

[30] Foreign Application Priority Data

Mar. 9, 1992 [DE] Germany ..... 42 29 375.8

[51] Int. Cl.[6] ..... H05B 3/68

[52] U.S. Cl. ..... 219/457; 219/463; 219/467

[58] Field of Search ..... 219/449, 463, 219/464, 465, 467, 468

[56] References Cited

U.S. PATENT DOCUMENTS

| | | | |
|---|---|---|---|
| 2,896,004 | 7/1959 | Duffy . | |
| 3,345,498 | 10/1967 | Siegla . | |
| 3,348,025 | 10/1967 | Bassett, Jr. et al. . | |
| 3,567,906 | 3/1971 | Hurko . | |
| 3,612,828 | 10/1971 | Siegla . | |
| 3,912,905 | 10/1975 | Giler . | |
| 3,984,615 | 10/1976 | Beck . | |
| 3,991,298 | 11/1976 | Maake . | |
| 4,161,648 | 7/1979 | Goessler . | |
| 4,292,504 | 9/1981 | Gebarowski . | |
| 4,350,875 | 9/1982 | McWilliams | 219/449 |
| 4,471,214 | 9/1984 | Gossler . | |
| 4,577,176 | 3/1986 | Bayer | 219/449 |
| 4,713,527 | 12/1987 | Kicherer . | |
| 4,789,773 | 12/1988 | Mikschi . | |
| 4,810,857 | 3/1989 | Goessler . | |
| 4,831,240 | 5/1989 | Davis . | |
| 4,845,340 | 7/1989 | Goessler et al. | 219/464 |
| 4,864,105 | 9/1989 | Goessler . | |
| 4,931,621 | 6/1990 | Goessler . | |
| 5,208,574 | 5/1993 | Mannuss et al. | 219/449 |
| 5,310,993 | 5/1994 | McWilliams et al. | 219/449 |
| 5,393,958 | 2/1995 | Gross et al. | 219/464 |

FOREIGN PATENT DOCUMENTS

| | | |
|---|---|---|
| 1962568 | 8/1970 | Germany . |
| 2551137 | 5/1977 | Germany . |

*Primary Examiner*—Teresa J. Walberg
*Assistant Examiner*—Sam Paik
*Attorney, Agent, or Firm*—Quarles & Brady

[57] ABSTRACT

At least one radiant heating resistor (10) formed from a corrugated flat material band has in different orientations projections (28) projecting from a corrugated longitudinal edge (14), which on the one hand for retaining purposes engage in an insulation (3) and on the other hand form longitudinal portions (39) with a slightly lower electrical resistance and which for the conventional operating power appear dark compared with the intermediate, visibly glowing longitudinal portions (38). Thus, on putting into operation, there is a very rapidly starting, punctiform lighting up of the corresponding longitudinal portions (38), which then spreads out to a wavy line, as well as a very reliable anchoring of the heating resistor (10).

30 Claims, 5 Drawing Sheets

Fig. 2
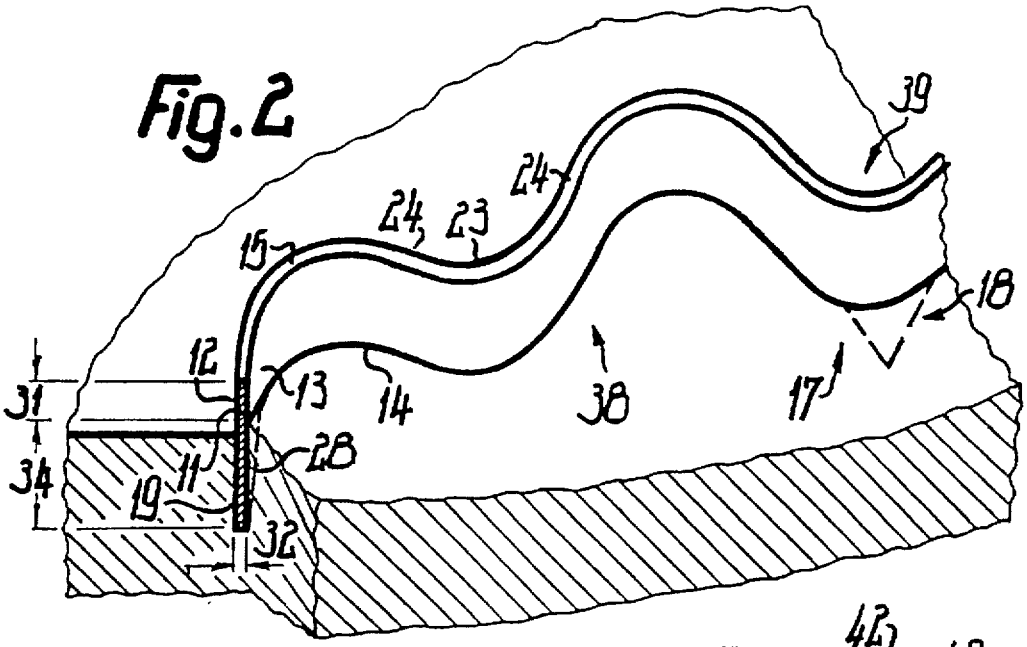
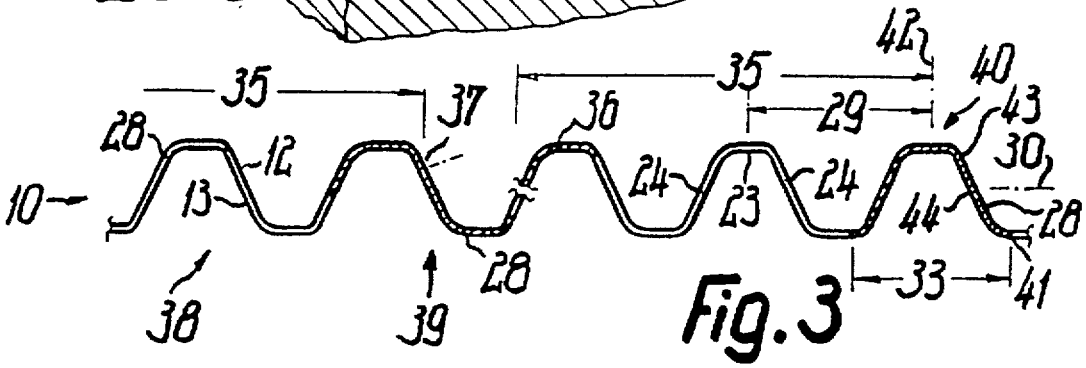
Fig. 3
Fig. 4
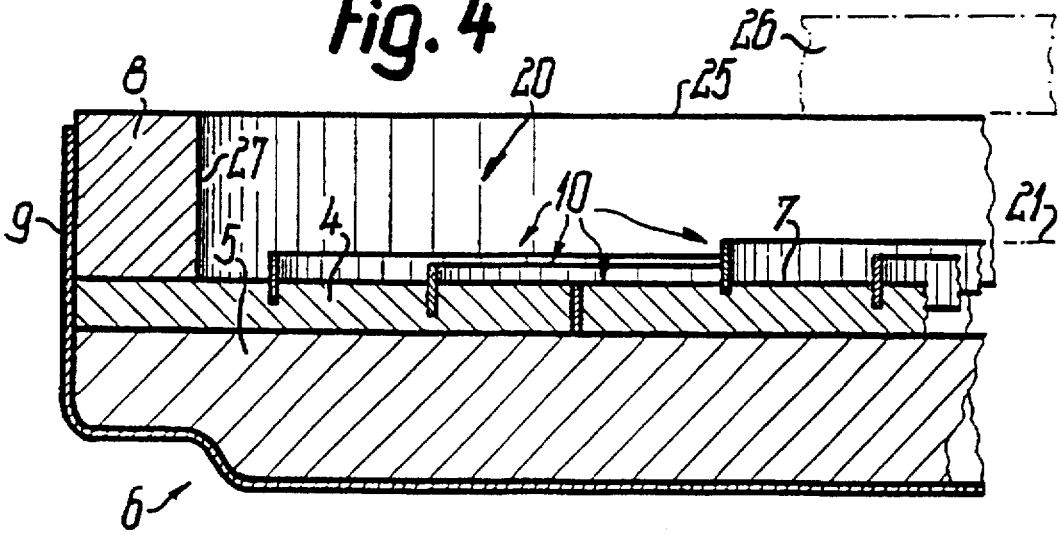

HEATER, PARTICULARLY FOR KITCHEN APPLIANCES

This application is a continuation-in-part of U.S. patent application Ser. No. 08/117,519, filed Sep. 3, 1993, now U.S. Pat. No. 5,498,853.

Background of the Invention

The invention relates to a heater or similar devices, which has at least one elongated resistor, such as a heating resistor, a series resistor, a luminous resistor, etc. Radiant heaters are preferably used for cooking appliances for the heating of a hotpoint, oven muffle or the like. The radiant heater appropriately forms an operably closed, preassembled unit, which can be fixed as a whole to a corresponding device, e.g. a hob, a muffle wall, etc.

In place of a resistor it is also possible to provide some other elongated component, which in particular in an appropriate manner influences She action or operation of the heater (e.g. the direction and distribution of the heating power which is given off). This component can have one or more retaining portions, support leas, etc., which can be separate or integrated therewith by one-part construction or the like and which is used for optionally reciprocal supporting with a single mating surface or mating surfaces facing one another.

As opposed to supporting with substantially only one edge face, it is advantageous to provide a much larger surface support, whose support region can also be spaced from an outer or peripheral edge face, which corresponds to at least 3, 10, 30 or 60 times the width of the edge face and which can only be 4/100 to 1/10 mm. The support leg can be uninterrupted over at least a ¼, a ⅓ or ½ the length or substantially the entire length of the component and therefore e.g. forms a strip-like marginal zone of the component, whose longitudinal edge forms the end apex of the support leg.

Instead of or in addition thereto there can also be spaced, succeeding support legs. If the particular support leg is not manufactured from a flat or foil-like starting material by separating or cutting along its edge boundary, but instead e.g. by permanent bending deformation from a wire-like material, then it can be in the form of a bow or part ring or in the form of a portion of a coil. In particular if the cross-section of this starting material is not polygonal, e.g. rectangular or square, but is instead circular, flat oval or elliptical, the support area is at a distance from he linear apex of the edge boundary corresponding to at least the minimum or maximum cross-sectional thickness of the starting material, said spacing being measured approximately at right angles to the edge boundary. In each case the support leg is advantageously flat to the extent that its width or length is at least 2, 4 or 30 times greater than said material thickness.

Constructionally the heater is appropriately arranged in such a way that on its heating side is visible from the outside at least one component or resistor at least over part of its length if said heating side is not displaced or concealed by a cooking utensil or the like. On said heating side the heater or the resistor is advantageously shielded by a translucent cover, e.g. a glass ceramic plate and is protected by it against direct contact. However, the component can also be provided with longitudinal portions or substantially over its entire length in completely flush, embedded or encapsulated form.

The smaller the material thickness of the starting material or the further said material thickness is below 1, 0.5, 0.1 or even 0.05 mm, the lower its strength, particularly its bending, buckling, tensile, tearing or thermal strength, particularly if it is regularly exposed to greatly differing temperatures of more than 200° or 500° to 1000° C. However, the strength is not only important during operation, but also before and during assembly, because then particularly high mechanical stresses or loads can occur. No protection is provided against such loads if following the insertion of the support leg in its operating position an end portion is bent at right angles for positive fixing, because only then is a certain stiffening obtained through the angular shape. In this operating position the non-prefabricated bend together with the transversely projecting end leg forms the end apex at the free end of the support leg.

The so-called glow pattern of a resistor which can be seen by the human eye and which is operated in the visible infrared radiation range, is dependent on numerous factors, e.g. the electrical operating power, cross-sectional changes of the resistor, its thermal coupling or also the shape of the resistor to the extent that this influences the current flow. If the heating resistor, e.g. as in German Patent 2 551 137, is constructed as a meander-shaped flat material strip, then there are power concentrations in the vicinity of the springing in ends of the meander cutouts. Therefore projections, which face the springing in ends on the outer edges of the meander projections have no visible influence on the glow pattern in the case that said resistor is operated in the visible radiation range.

OBJECTS OF THE INVENTION

The object of the invention is to provide a radiant heater, which avoids the disadvantages of known constructions and of the described nature and which in particular ensures reliable assembly connections for weakly dimensioned components or an effective influencing of the visible glow pattern in the case of a simple construction.

SUMMARY OF THE INVENTION

According to the invention also means are provided in order to influence one or both lateral faces or support flanks of a weakly dimensioned component with regards to its strength, e.g. in that with the particular support flank or region is associated a Drefabricated profiled part. At least one lateral face or support flank in a profile area spaced from the end apex zone can at least partly have an orientation which differs from an orientation at right-angles and/or parallel to the straight or curved median longitudinal axis of the component, the material cross-section of the portion having the support flank in the profile area differing from a centrosymmetrical cross-section in the state assumed by said portion in operation. The profile area can also be provided approximately parallel to said longitudinal direction and/or in at least one, two or more inclined positions with respect to said longitudinal direction, e.g. can assume alternating directions. In the case of a bow-shaped support leg, apart from a possible helical pitch, also in the vicinity of at least one bow leg and/or the bow apex it can be bent once or several times at right angles to the bow or pitch plane, so that e.g. areas which in cross-section are at right angles to the leg longitudinal direction are displaced against one another transversely to said plane.

As a result of the profiling or the like it is possible to create means for modifying and in particular increasing said strengths, particularly the dimensional rigidity. The profiling can e.g. form a spade-shaped curved channel or guide profile, which forms an extraction preventor by two-sided, substantially whole-surface friction engagement in the mating surface, but which during assembly provides a positively securing guidance against lateral movements. The profiling can also form a compensating profile elastically stretchable and/or compressible at right angles to its longitudinal direction for mechanical, thermal or similar stresses. The profiling is also suitable for a large-surface, thermal coupling to the mating surface. If the profiling in one to all directions is substantially rigidly connected to the component or forms an extension of a profile deformation of said component, it can also significantly influence or increase said strengths of the component. Finally, in its vicinity, the profiling can also influence the heating action e.g. in that the current flows through it over part or the entire leg length in the manner of a parallel resistor or the like and consequently optionally increases or decreases the heating power in its vicinity compared with adjacent longitudinal portions of the component.

The profiling can admittedly also be provided in a cross-section parallel to the leg longitudinal direction, but it is appropriate to provide it substantially exclusively only in cross-sections at right angles to the leg longitudinal direction, so as in simple manner to form a plug-in member, which without preceding manufacture can be inserted in a plug-in opening in a suitable material and thereby produces said opening precisely adapted in clearance-free manner thereto and closely seals the same at the open end or on the free surface of the material. The profiling then has in all longitudinal portions parallel to the leg longitudinal or plugging direction on both remote or complementary sides and over the entire plug-in depth or leg length parallel circumferential lines, which in linear extension can also be linearly extended over most of the height or the entire height of the component.

The construction according to the invention is also suitable for the supporting of the support leg in the vicinity of an edge face or the end apex only. Optionally in the case of a substantially planar outer shape, it can be formed by a two or multiple-layer construction of the support leg, adjacent layers engaging on one another in large or whole-surface manner and/or can have a small spacing roughly the same as the material thickness. The multilayer structure can e.g. be obtained in simple manner by folding, the particular fold edge forming the end apex and/or a lateral longitudinal edge of the support leg and leading to a thickening of the cross-section.

The retaining portion or the component is preferably initially separated or cut from a planar or flat and non-preprofiled layer or laminated material, such as ultra-thin sheet material and only subsequently are the profilings produced and consequently the component is shortened to its effective length. A single separating cut can simultaneously form two complementary edge faces from two components which were approximately mirror symmetrical prior to the complete separation and which can thus be produced in e.g. completely wastefree manner, if a projection or support leg of one component as regards its outer contour precisely corresponds to the gap between two projections of the other component.

Independently of the described construction it can also be advantageous for at least one profiling of a component or support leg to be in the form of a fine profiling, in which the two profile legs emanating from the profile apex, as a function of requirements, have a maximum spacing from one another or in each case have a length from one another of less than 2 to below 0.5 mm. Between said values said amount can vary in steps of 0.1 mm. Thus, in the case of a tape or strip-like resistor or the like the effective length of the component or resistor material can be much greater than the actual length of the component in the operating state, i.e. in its laid length. In the case of a resistor it is particularly appropriate if it is operated at a rated voltage of above 230 V, e.g. approximately 400 V, because then through the correspondingly increased surface of the resistor its specific thermal surface loading is reduced for the same power. Two or more profilings of different fineness produced by permanent deformation can be superimposed. For example portions having a larger wavy profiling can be provided with a finer or smaller wavy profiling in such a way that e.g. one full wave of the larger profiling contains 5, 10 or even 20 full waves of the smaller profiling. Whereas the largest leg spacing of a U or V-shaped profile unit of the larger profiling is approximately the same as the height of the exposed resistor portion, with the fine profiling it is below a ½, a ¼ or a 1/10 of the height and the spacing can correspond to at least 1, 3 or 5 to 10 or 20 times the material thickness of the fine profile.

Means for increasing the resistance value or for limiting the main resistance-active area can be formed in continuous manner in individual length portions and/or over the entire length of the resistor by openings continuing over the starting material cross-section. These openings can be provided in the support leg or in the resistance-active main portion of the component in one, two or more rows parallel to its longitudinal direction and influence the heating behaviour of the heater in the in each case associated portion. For example a plurality of openings can be distributed in grid-like, closely juxtaposed manner in a field or panel and a plurality of the latter can be distributed with larger intermediate spacings over the component length. In the vicinity of the particular opening with only part of its length the support leg forms a resistanceactive area.

According to the invention, independently of the described constructions, means or a method for adjusting the resistance value of a resistor are proposed. According thereto the actual value of the resistance is determined, compared with the desired value, from this the actual value divergence is determined and without modifying the effective resistor length, the resistor is worked in such a way that its resistance value approaches or matches the desired value. Working does not take olace on the ends of the resistor strand, but instead spaced between them by cross-sectional thickening and/or material removal, e.g. by producing the indicated folds or openings. If such openings are already present, then for matching the resistance value its intermediate spacings and/or sizes can be continuously varied, which permits an extremely accurate resistance matching. Material removal can take place in computer or microprocessor-controlled manner using a laser jet and in the manner of ultra-fine perforation. The opening can have a width of less than 1 or 0.5 mm or more than 1.5 or 2 mm. The intermediate spacings between adjacent openings can be of the same order of magnitude.

Independently of the described constructions, according to the invention it can be advantageous if there is a temperature sensor of a thermal cutout or the like monitoring the heating power or temperature of the heater in a view on the heating plane in an area in which at least the power or arrangement density of the heating means or resistor is much smaller than in the maximum density areas of this type. Said area can also be substantially free from radiant portions of the heating-active component and/or other components or can be formed solely through the substantially planar surface of the insulating material or the carrier or support for the component. This construction is particularly appropriate for a temperature sensor, which instead of extending over the entire width of the heating field only extends approximately up to its unheated central zone, in which the temperature sensor and the carrier can be supported against one another. As a result of this construction the rodlike temperature sensor can be moved relatively close to the surface of the carrier in order to obtain a shallower construction of the heater and in addition direct thermal reflections from the sensor to the component are avoided and which could damage said component.

According to the invention means are also provided through which the same resistor forms portions of such a size and such an intermediate spacing that an average capacity human eye can clearly detect brightness contrasts of said portions during power consumption, shortly prior to the start of power supply and/or some time after interrupting the power supply. In a view of the heating side the particular portion at right angles to its longitudinal direction assumes a maximum band width and appropriately the length of the lighter and/or darker portion is at least half as large, the same or several times larger than said band width, so that lighter and darker portions can be clearly distinguished from one another.

The resistor can be constructed in such a way that the portion provided for lighter illumination in the heating-up phase, i.e. at the start of power supply, in the cooled state initially starts to light up in punctiform manner in the centre and said light or luminous spot enlarges with heating in opposite longitudinal directions of the resistor to form a luminous or light line which, on reaching the operating temperature, has essentially reached its constant luminous length and its ends are connected in relatively contrastsharp manner or with abrupt brightness decrease to a darker longitudinal portion. In a view of the layer plane of the resistor the light line can be linear or slightly curved, zig-zag-shaped, wavy and/or the like. Whereas the resistor glows relatively brightly in the vicinity of the light line, it glows less in the vicinity of the darker portion or does not glow in the visible range, so that said darker portion can be indirectly illuminated by the lighter or brighter portion and therefore the contrast becomes even more apparent.

One or several resistors can be provided in the vicinity of a common field, e.g. in nested or adjacent turns or with juxtaposed longitudinal regions, which are longer than those grid regions, which are formed by the lighter and darker longitudinal portions. In the longitudinal direction of the heating resistor or at right angles thereto succeeding lighter or darker longitudinal portions can have the same or different lengths, succeed one another in a continuous line or can be reciprocately displaced at right angles to such a connecting line. They can also have identical or different intermediate spacings, be arranged within a limited or the total resistance field in a uniform, regular or different distribution density and also visibly luminous portions can have clearly distinguishable brightness. This makes it possible, as a function of the particular setting or power state of the radiant heater, to provide clearly distinguishable glow patterns, which not only make it possible to establish by visual checking as to which heating resistor or resistors are in operation, but also form the different, mosaic indicating symbols.

The construction according to the invention also makes it possible to significantly shorten the time between the start of power supply and the first, visible lighting up namely below ten or five seconds or even below four seconds. For example, the first tiny luminous spots in the case of a very limited interfering brightness can be seen only one second after switching in the power supply and after three to four seconds the luminous lines have already reached their complete length. In order to obtain an advantageous fine grid pattern of the individual luminous units, per $cm^2$ of heating surface there are appropriately on average at least one or 1½ light or dark portions, so that e.g. in the case of a heating field with a diameter of approximately 18 cm there are approximately 200 light and 200 dark portions. However, the grid pattern can also be significantly improved compared therewith by increasing the number of contrasting portions in such a way that it is doubled or tripled. It has proved advantageous if the maximum operating temperature between the light and dark portions differs by at least 5° to 10° or 50° or approximately 100°, if it is approximately 1000° to 1050° C. for the light portions or approximately 950° to 1020° C. for the dark portions, so that the operating temperature is below 1000° or 1015° C. in one case and above it in the other.

If over its entire length the resistor is in contact at several points or in approximately uniform distribution with an electrical or thermal insulation, then at these points there is in each case a direct heat conducting coupling between the different materials of the resistor and the insulation. If the insulation has cooled to well below its operating temperature, e.g. roughly to ambient temperature, then on putting the resistor into operation it can initially absorb heat at the indicated points, but said heat consumption is essentially ended when the insulation has reached its operating temperature of approximately 1000° C. This heat dissipation or abstraction encourages the punctiform start of lighting up and the thermal characteristic thereof encourages the development of the light spot into the light line.

Independently of the described construction the resistor can have projections offset transversely to its longitudinal direction and which are used for engagement in a mounting support for the resistor, e.g. in the said insulation. These projections are appropriately so arranged and constructed that they essentially only secure by friction grip or force closure and not in interlocking manner. The particular projection can be engaged in one or two directions which are at right angles to one another and transverse to the insertion direction of the projection in pretensioned elastic manner against corresponding mating surfaces of the mounting support, so that the friction grip is increased. For example, the resistor adjacent to the particular projection can be elastically extended by stretching compared with its relieved state or can be elastically shortened by compression, so that the entire projection engages in pretensioned manner in the insulation in the longitudinal direccion of the resistor. The projection is appropriately formed by one of the described support legs.

The resistor can also be elastically curved about an axis way outside its lateral faces to a narrower or wider curvature, so that the particular projection is consequently pressed transversely to the longitudinal direction of the resistor against the mating surfaces of the mounting support. The projection can also be constructed in an intrinsically resilient manner, e.g. in channel-like form or in the form of a portion of a cone jacket and can consequently form prong-like spring legs, which are pressed in divergent or convergent elastic manner against the associated mounting surfaces of the support. If the projection is connected in appropriate manner to a flat cross-section or the like or constructed in one piece therewith, there is a curvature behaviour of said strand-like overall component, which in the vicinity of the projection specifically differs from that in those areas having no projection. If such a strand is curved in the elastic area in circular manner about an axis roughly parallel to the longitudinal direction of the projection, such as is e.g. the case on passing into spiral turns, then the free end of the projection performs a slight tilting movement towards the concave curvature side. As projections are in different arcuate portions, they consequently perform differently directed tilting movements and are then slightly inclined to the direction in which the resistor is inserted in the mounting support, said direction being e.g. at right angles to the heating plane. The different tilting positions of the projections then lead to an even better securing of the resistor with respect to the mounting support.

The projections can coincide with the darker portions of the resistor, so that with respect to the number and distribution density thereof what was stated hereinbefore with regards to the light and dark portions again applies. The projection appropriately forms with only a limited part of its height a resistance-active area or an area through which the current flows, which reduces the resistance value of the associated resistor portion in such a way that it appears as a dark portion in the described manner. For this purpose the projection with an area of greatest cross-section is connected to the associated longitudinal edge of the remaining resistor, the projection tapering to its free end from said cross-section over part or all its height.

The specific resistance values or power densities in the portions with and without projections or support legs can be chosen approximately identical or can be constructed in such a way that they do not differ with respect to the operating characteristic, which is e.g. defined by the resistance-active cross-section, the thermal storage capacity, the thermally conducting coupling, the larger of two cross-sectional extensions at right angles to one another, the visible light brightness, etc. To this extent adjacent, but differently constructed or all the portions in at least one of said operating states can form a line of substantially uninterrupted, identical brightness, without this giving a broken line pattern.

BRIEF FIGURE DESCRIPTION

These and further features can be gathered from the claims, description and drawings and the individual features, both singly and in the form of subcombinations, can be realized in an embodiment of the invention and in other fields and can represent advantageous, independently protectable constructions for which protection is hereby claimed. The invention is described in greater detail hereinafter relative to embodiments and the attached drawings, wherein show:

| | |
|---|---|
| FIG. 1 | a detail of a heater according to the invention in perspective view. |
| FIG. 2 | a detail of FIG. 1 on a larger scale. |
| FIG. 3 | a further embodiment of a resistor in plan view. |
| FIG. 4 | a further embodiment of a radiant heater in cross-section. |
| FIG. 5 | a larger scale detail of a radiant heater in axial section. |
| FIGS. 6 and 7 | two further embodiments in representations corresponding to FIG. 5. |
| FIG. 8 | a further embodiment in a representation similar to FIG. 5. |
| FIGS. 9 to 11 | three further embodiments in representations corresponding to FIG. 8. |
| FIG. 12 | a much larger scale detail of a further embodiment. |
| FIG. 13 | two further embodiments in a representation corresponding to FIG. 12. |
| FIG. 14 | a radiant heater in a view of the heating side. |
| FIG. 15 | a detail of FIG. 14 in cross-section. |

DETAILED DESCRIPTION OF THE PREFERRED EXAMPLE EMBODIMENTS

Figure 1:
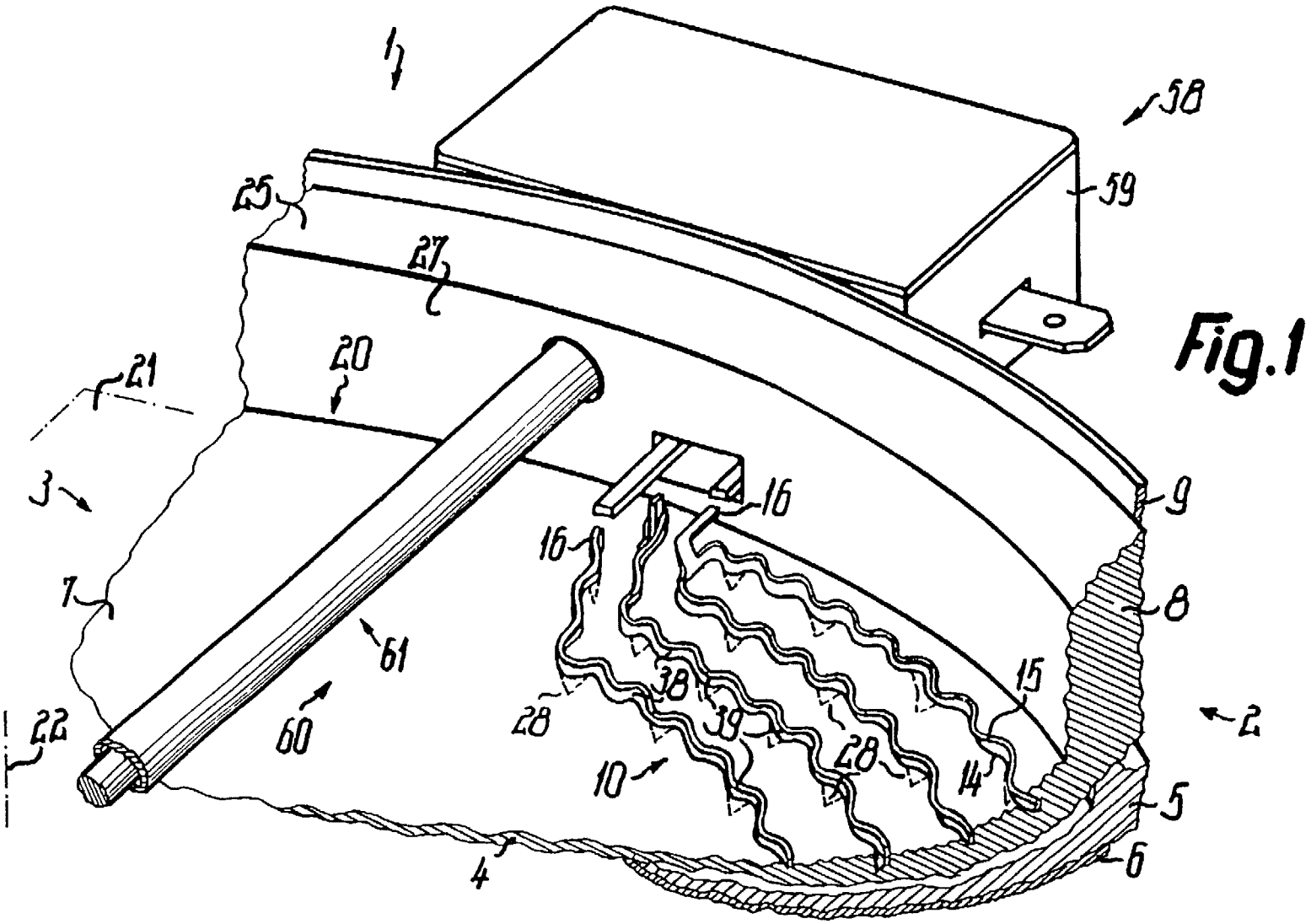

The radiant heater 1 has a substantially dimensionally stable, multipart and cup-shaped body 2, whose cup opening substantially completely forms the thermal outlet. The largest material volume of the body 2 forms a substantially two or three-part insulation 3 from a support member 4 and an insulating member 5. The support member 4 has in particular electrically insulating characteristics and forms the substantially planar and/or smooth-surfaced cup bottom exposed with respect to the thermal outlet. The support member 4 is supported flat on an approximately plate-like insulating member 5, which has better thermal insulating characteristics than the support member 4 and can engage thereon only in the edge and/or at least one ring area, so that a large-surface, free gap is left between the two members 4,5. The mechanical strengths, such as the compressive, bending, tensile and/or shear strength of the insulating member 5 can be lower than those of the support member 4 and both are located in a holder 6 made from a material having higher strengths, e.g. a sheet metal tray, which axially and/or radially secures the insulation 3 in a substantially clearance-free manner.

Over the bottom 7 of the insulation 3 projects axially a ring-like, through, insulating material edge 8 forming the cup opening and which according to FIG. 1 is constructed in one piece with the support member 4 and is made from an insulating material which is similar to that of the support member 4 and/or the insulating member 5. This edge 8, whose radial thickness is greater than that of the support member 4, is closely surrounded by a jacket-like edge 9 of the holder 6, which in the fitted state is axially set back with respect to the free end face of the insulation 3, e.g. by an insulating ring engaged on the edge 8.

To the base 7 are fixed several elongated, strand-like components or resistors 10 in such a way that they are secured in substantially clearance-free manner with respect to movements parallel to the base 7 or to their longitudinal direction and against raising movements transversely to the base 7. The resistors 10, which are here in the form of heating resistors and are at least partly freely positioned within the cup area, can be arranged in nested, single or multiple sDiral turns or spirals roughly parallel to the edge 8. The resistors 10 are preferably substantially uniformly distributed over a field, which is connected over the entire circumference approximately to the inner circumference of the edge 8 or extends into the centre of the base 7.

In the exposed area, each resistor 10 has over its entire length substantially through, precisely identical, approximately rectangular flat cross-sections in that it is made from a flat band.

The flat band is permanently deformed in the plastic state and also in the elastic area by bending. It has two cross-sectionally parallel lateral faces 12,13 and two very narrow edge faces 14,15 connecting them. Its thickness 32 can e.g. be approximately 0.07 mm and its maximum cross-sectional width 28 is e.g. approximately 4 to 8 mm, particularly 6 to 7 mm. The particular band end of the resistor 10 can be constructed directly and without additional intermediate members as an electrical connection end 16. It can be brought by bending or setting with respect to the remaining resistor 10 into a position in which it is contact-free relative to the insulation 3 and is particularly suitable for electrical connection.

The particular connection end can also be directly formed by a further, undeformed band end, such as occurs if the band is cut off by a separating cut transversely thereto at a random appropriate point of its length. The band end can also be bent round in ring or fold-like manner and between its fold legs can be fixed a transversely projecting connecting pin, which e.g. over its entire length has identical, flat, rectangular cross-sections. The connecting end is freely movable to an at least slight extent transversely to the base 7 and in all directions parallel thereto, so that it can be satisfactorily aligned with respect to those countermembers to which it is to be connected for its electrical connection.

A one-piece, through flat band can also form two adjacent, separately switchable resistors, if the latter pass at their ends via a transverse portion in one piece into one another and/or the transverse portion connecting said individual resistors is constructed in one piece with a corresponding connecting end.

The resistor 10 forms an interrupted, through fixing portion 17 over most of or its entire length, in that over said length with interruptions it is so directly engaged with the support member 4, that it is secured with respect to the latter against movements in said directions. For this purpose an engagement portion 18 connected to an edge face 14 with projections 28 is embedded in closely adapted manner in corresponding depressions 19 of the support member 4. The flat cross-section 11 forms between the two edge faces 14,15 uninterrupted, through, resistance-active cross-sections, which are enlarged by approximately 10% or less in the vicinity of the projections 28.

The engagement depth of the projections 28 or the engagement portion 18 can e.g. be approximately 3 to 4 mm or roughly the same or more than half the total width 31,34 of the flat band. In the vicinity of the common longitudinal portion or the projection, the two lateral faces 12,13 can engage with different height on the insulating material of the support member 4 or with the same height, as a function of which radiation conditions or thermal coupling effects are to be obtained. As a function of whether the spiral portion is elastically pretensioned in an area by widening or narrowing, it engages under spring tension with the inner or outer lateral face 13 or 12 of the projection forming the support faces.

The resistors 10 engage on the heating side 20 of the base 7 facing the cup opening or the body 2 and determine e.g. with their edge faces 15 closer to the thermal outlet a heating plane 21 roughly parallel to the base 7. The heater 1 has a central axis 22 at right angles to said heating plane 21 and around which the resistors 10 are curved. In addition to its large elastic curvature each resistor 10 has a profiling, namely e.g. a sine wave-like curved configuration alternating in its longitudinal direction. In a view of the heating plane 21, the resistor 10 is provided in alternating manner with oppositely directed, but substantially identical curves 23 and adjacent curves pass in one piece into one another with their approximately linear or planar legs 24.

Correspondingly the projections 28 and the depressions 19 are curved in permanent or intrinsically stiff manner, the legs 24 diverging from the curvature 23 appropriately under an angle of more than 30°, 60° or 90°. Thus, thermal longitudinal expansions of the resistor are transferred in virtually problem-free manner to the support member 4. The corrugation is substantially permanently produced by bending in the plastic range, but in its length area permits additional elastic deformations, e.g. for producing the large curvature, for lengthening or shortening the resistor and for curving the resistor transversely to the heating plane 21, so as to be able to adapt the resistor in this area to the shape of the base 7.

The inner circumference 27 of the edge 8 which, according to FIG. 4, can also form a component separate from the support member 4, defines the thermal outlet of the heater 1 on the outer circumference. According to FIG. 4 the free face 25 of the edge 8 projects by a slight amount over the face of the edge 9, so that a radiopaque cover plate 26 made from glass ceramic or the like can engage on its face 25 in pretensioned form with its planar back or underside and under pressure. The projecting amount, which can e.g. roughly correspond to the sheet metal thickness of the holder 6, is sufficiently large that between the back of the cover plate 26 and the edge 9 only a gap spacing is provided. If the face 25 diverges under pressure or by aging of the edge 8 with respect to the heating plane 21, the edge 9 does not come into direct contact with the cover plate 26 and instead the gap spacing is reduced at the most to e.g. 1 mm or the like.

The heating plane 21 is spaced from the face 25 or set back from the cover plate 26. The heating resistor or separate heating resistors can project to a different extent over the base 7 towards the heating side 20, can engage to different depths in the support member 4, can have different band widths, different projections and/or different band thicknesses, so that areas of the heating field can be created which have different power densities or different response sensitivities with respect to the heating action and glowing.

The projections 28 are appropriately so incorporated into the corrugation that the particular projection has the same corrugation curvatures as the remaining portion of the flat cross-section 11 at least in the transition to the edge face 14, over most of its height and to close to its free end. As towards its free end the projection 28 terminates in a sharp or rounded tio 37 or in an end apex, the latter can be free from such curvatures in individual or all the projections. In the pressed flat state or as a planar bend the particular projection is approximately acute-angled triangular, its greatest extension in the longitudinal direction of the resistor 10 being roughly the same as a Lull wave of the corrugation or is only slightly smaller than the latter. Thus, the projection extends over one or two curves 23 and over one or two legs 24. The internal spacing between successive projections is appropriately larger than this extension.

As can be gathered from FIG. 3 the corrugation can also be shaped like a trapezoidal tooth system, so that the portions 23 approximately parallel to the longitudinal direction of the resistor 10 are approximately planar and pass via relatively small radii of curvature into the legs 24. In succeeding manner alternately s maller and larger radii of curvature can be provided, so that the corrugation in simple manner can be uniforply produced over the entire resistor length between two gear wheels meshing with symmetrical teeth.

With respect to the fixing projections 28, in a view of the heating side 20, they can be approximately completely congruent to the remaining flat cross-section 11 of the heating resistor 10 or over its lateral face project at the maximum by approximately one or two times its material thickness 32 e.g. as a result of slight tilting.

The fixing projection 28 engages in completely flush manner in the support member 4, which can also be in one piece up to the bottom of the holder 6, so that there is no need for superimposed insulating Layers for forming the insulation 3. The edge face 14 of the resistance-active flat cross-section 11, which is approximately at right angles to the heating plane 21, can at least partly also engage in sliahtly countersink manner in the support member 4. However, the edge face 14 can at least partly engage directly on the planar surf ace of the base 7 or can at leas t partly have a lga spacing from said surface.

The projections 28 are approximately uniformly distributed in the manner of a tooth system over the length of the resistor 10. Compared with the largest cross-sectional width 31 of the flat cross-section 11, the fixing projection 28 appropriately has a larger overall width 33, whic h can be larger than its height 34. This height 34 can approximately be the same as the cross-sectional width 31 or can be larger than the latter.

Figure 5:
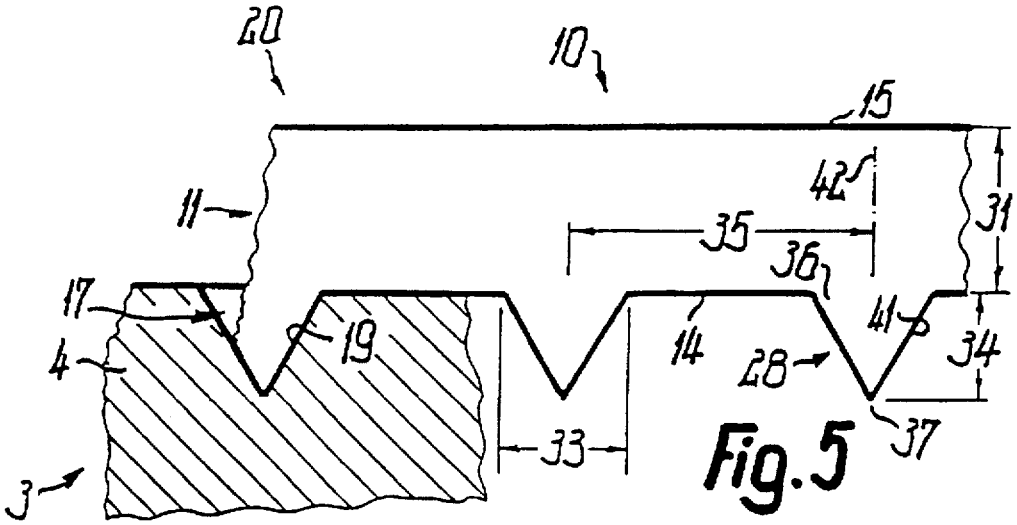

According to FIG. 5 the fixing projections 28 in side view are linearly bounded in right-angled to acute-angled manner by their lateral edge boundaries or outer edges, so that at the free end is formed a corresponding tip 37 as a tip for insertion in the dry, prefabricated or still moist, shapeable support member 4. Prior to pressing in the resistor 10 can be elastically stretched or compressed at least over portions thereof counter to its spring tension and is then pressed in this state into the support member 4. After freeing the longitudinally variable tension, the longitudinal portion springs back and engages with tension on the support member 4, so that the resistor is frictionally secured against raising from the base 7. The projections 28, including the tips thereof 37 are completely located within the support member 4, although the tips could also extend into the insulating member 5.

In FIG. 3 the length of a full wave or corrugation is designated 29 and it can be seen that the width 33 to be measured Darallel to this length is about ⅓ smaller. The central spacing 35 between successive projections 28 or their tips 37 is larger by a non-integral factor between 4 and 5 compared with half the amount 29. Thus, each projection 28 or its tip 27 assumes a different position with respect to the central longitudinal plane 30 of the resistor 10 and substantially each projection 28 in cross-section according to FIG. 3 has a different shape from e.g. three to five angle portions connected to one another at an angle. This leads to a very favourable claw engagement of the resistor with respect to the support member 4.

Figure 6:
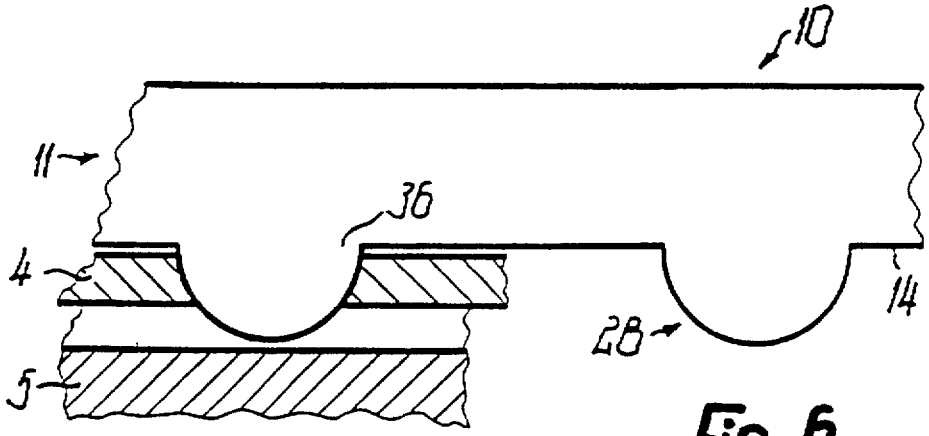

According to FIG. 6 the fixing projections 28 are bounded in arcuate or approximately semicircular manner. It can be seen that the edge face 14 following onto the foot portions 36 of the projections 28 has a gap spacing from the free face of the base 7, said gap spacing being significantly smaller than the amounts 31,34 or is approximately the same as the resistor material thickness. The free end of the fixing projection 28 can also be exposed over part of its height, e.g. in that it engages in optionally contact-free manner in a depression or recess of the insulating member 5.

Figure 7:
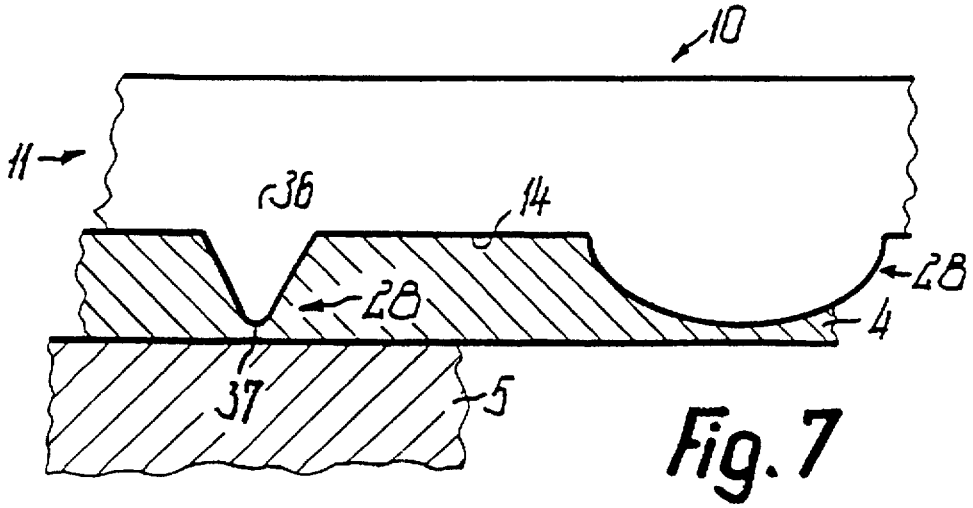

FIG. 7 shows a construction with differently shaped fixing or fastening projections 28, namely a projection which instead of being part circular is approximately part elliptical and a triangular projection with a rounded tip 37. The round projection 28 to the right in FIG. 7 has a markedly widened foot portion 36, so that over its length the effective resistance of the flat cross-section 11 is correspondingly reduced.

For a substantially identical electric power supply the longitudinal portions 38 between the projections 28 light up brighter and/or upstream of the shorter longitudinal portions 39 occupied by the projections 28, because at least the root or foot portion 36 is incorporated to a lesser height into the conductor cross-section through which the current flows and consequently the electrical resistance value is correspondingly reduced. As on putting into operation the still cool resistor 10 also the longitudinal portions 39 and the support member 4 are not or not significantly heated above ambient temperature or their temperature is a few 100° C. below the operating temperature, they can initially absorb by heat conduction a large amount of heat from the longitudinal portions 38 with the highest resistance value. Thus, the longitudinal portions 38, initially roughly in the centre between the adjacent longitudinal portions 39 on either side start to visibly glow in punctiform manner and consequently heat the following zones in the longitudinal direction until the glow point has spread to a glow line following approximately onto the adjacent projections 28.

The projections 28 or longitudinal portions 39 and the zones of the support member 4 in this area have then reached their operating temperature, in which they can no longer absorb or dissipate heat from the longitudinal portions 38. Compared with the glow brightness of the longitudinal portions 38, the longitudinal portions 39 appear dark, although in a longer wave region of the infrared radiation they also provide heat emission to the thermal output of the radiant heater. In the described manner the light or luminous lines are wavy and successive light waves, as described with respect to the wave shape of projections 28, have a different shape. After cutting out the power supply in the operating state the longitudinal portion 38 over approximately its entire length cools in a substantially uniform manner, so that it correspondingly uniformly loses luminous intensity.

As can in particular be gathered from FIG. 3, as a result of the described construction within the width 33 of the support leg 28, the component 10 has a profiling 40 of the described type, which is either only outside the substantially planar support leg 28, namely between the edge faces 14,15, only in the vicinity of the support leg 28 with a substantially planar construction between the edge faces 14,15, or both between said edge faces 14,15 and in the vicinity of the support leg 28. If the lateral edge boundary 41 of the support leg 28 is provided with an incision, a recess, etc., then the profiling 40 of the support leg 28 can differ from that between the edge faces 14,15. In a longitudinal view through each incision the support leg 28 forms an edge leg or strip having the associated edge boundary 41, which can be inwardly or outwardly bent at right angles to its surface so as to form a wider or narrower profile compared with the remaining profile. Incisions can e.g. be provided in the foot area 36 or in the extension of the edge face 14 as from the two lateral edge boundaries 41 over less than half the width 33 and/or spaced therefrom and spaced from the end apex 37. Facing incisions can be aligned with one another or reciprocally displaced towards the length 34. In each case the profiling 40 is so associated with the support leg 28 that its strength, the strength of its connection with the remaining component 10 and/or the strength of this remaining component 10 in the vicinity of the cross-sectional width 31 changes and in particular rises. The incision is advantageously produced as a waste-free separating or punching cut. After bending out the cut free parts of the support leg 28, its support flanks 43,44 in a longitudinal view of the support leg 28 can at least partly be located outside the lateral faces 12,13 of the remaining component 10. For example, both support flanks 43,44 or the particular edge boundary 41 can be spaced outside a lateral face 12 or 13. In the vicinity of the end apex 37 the support flanks 43,44 are appropriately roughly congruent to the lateral faces 12,13.

The spacing between the median longitudinal planes 42 of adjacent support legs 28 can also be substantially the same as the dividing spacing 29 or the length of a full wave or a profile unit. Then successive median longitudinal planes 42 coincide with symmetry or median planes of said profile units and with each support leg 28 is roughly associated the same profiling 40. Instead of once the amount 29 the spacing can also be 2, 3 or more times this amount 29.

Figure 8:
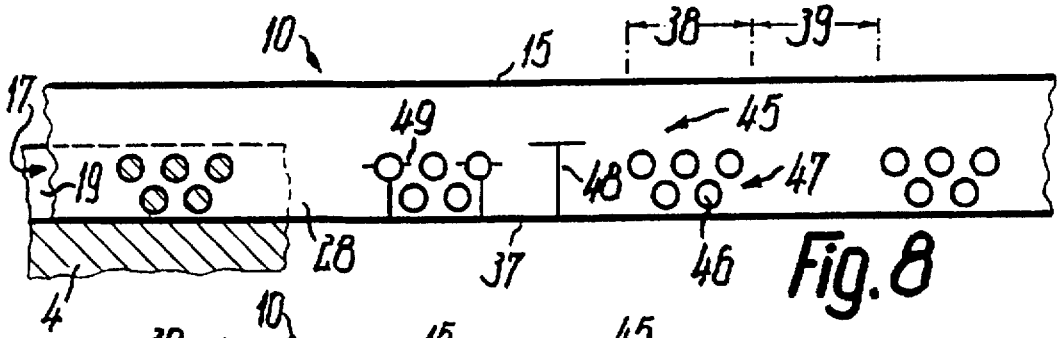

According to FIG. 8 the total width 31,34 of the component 10 over most of its length can be substantially constant or in this area the edge face remote from the edge face 15 can be linear. This edge face is formed by the end apex 37 of a single support leg 28, which in turn forms a through marginal strip of the component 10. In this marginal strip can be provided in a division corresponding to 29 or 35 incisions of the described type, which pass out from the end apex 37 at right angles or transversely and in the foot region of the support leg 28 pass into one or more cross-sections, so that they are e.g. T-shaped. Thus, the profiling of the support leg 28 can once again be changed compared with that of the remaining area of the component 10.

According to FIGS. 8 to 11 there are means 45 for modifying the working or heating behaviour, as a result of which both the mechanical behaviour of the component 10 during its shaping, assembly and under thermal length changes, and also the resistance of the particular longitudinal portion can be influenced or modified. For example, in the support leg 28 there are approximately equal size openings 46 or holes, which can be arranged in grid-like manner in a field or panel 47. Fields 47 succeeding one another in the longitudinal direction of the component 10 have a spacing from one another which is greater than the intermediate spacing between openings 46 within the field 47 or is at least roughly as large as the extension of the field 47 in the longitudinal direction of the component 10. The openings 46 are provided in two parallel rows in the longitudinal direction of the component 10, the row of each field 47 nearer to or immediately adjacent to the end apex 37 having at least one opening less than the row further therefrom. Thus, the field 47, which can be formed only by a single opening is widened towards the edge face 15.

The means 45 can also be formed by the incisions 48,49. If such an incision 48 is provided in spaced manner roughly in the centre between adjacent fields 47 or in the centre of such a field 47, then it is appropriately T-shaped. If the strips cut free by the incision 48 are bent from the surface of the remaining flat cross-section to the same or opposite sides, then their electrical line connection is separated and in the vicinity thereof the resistance of the component 10 increases. Miuch the same occurs if the incision 49 is formed by two parallel transverse incisions emanating from the end apex 37 or the edge face 14 and which in each case pass into a longitudinal incision parallel to the longitudinal direction of the component 10, said longitudinal incisions being directable against one another and/or away from one another. According to FIG. 8 the transverse and longitudinal incisions traverse the boundary of an outermost opening 46 of the associated field 47.

A transverse incision or a T-shaped incision could also emanate from the end apex 37 of a support leg 28 constructed as a projection. Through the particular field 47 in the vicinity thereof the electrical resistance of the component 10 is modified and in particular increased, the resistance increase being so adaptable by the incision 48 that in its vicinity the resistance is approximately the same as in the vicinity of the field 47, so that the interconnecting longitudinal portions 38,39 light up with approximately the same brightness in at least one of the said operating states. The openings 46 or incisions 48,49 are appropriately completely covered by the mating surfaces 19 formed by the depression of the support member 4, so that the material of the latter can engage in the openings 46 or the cutting edge faces.

Figure 9:
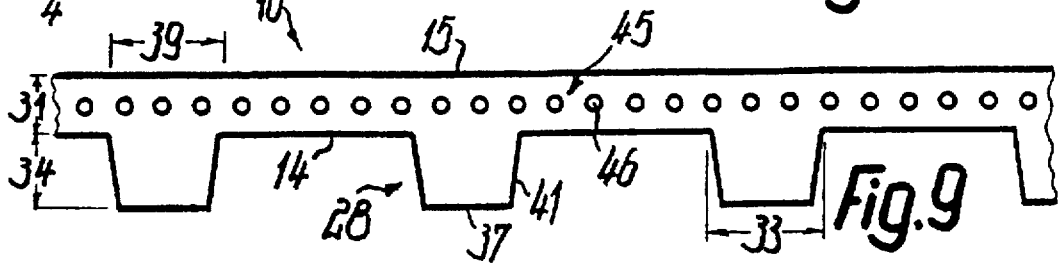

According to FIG. 9 the openings 46 are provided in a single row roughly parallel to the edge faces 14,15 and are spaced and roughly in the centre between said edge faces 14,15. The support legs 28 do not have openings, but there are openings in those longitudinal portions 39 which have the projections 28. The row with openings 46 having approximately identical intermediate spacings extends over most of the length of the component 10 or over the entire length thereof. By even minor changes to the intermediate spacings or the sizes of the openings 46 the resistance value of the entire component 10 can be continuously modified, namely by increasing the intermediate spacings or decreasing the openings it is decreased, whereas it is increased by reducing the intermediate spacings and enlarging the openings 46. In a view on their lateral faces the projections 28 here are approximately trapezoidal, so that there is a linear apex edge 37 approximately parallel to the edge face 14,15 and whose length, as a function of requirements, can be larger or smaller than the amount 31 or 34.

Figure 10:
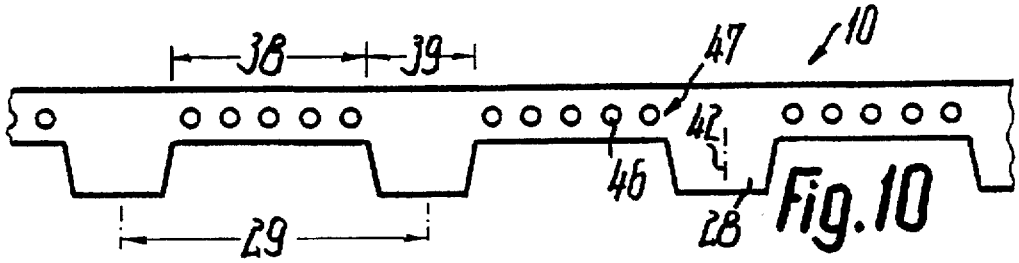

According to FIG. 10 the openings 46 are again provided in line fields 47, which only are located in the longitudinal portions 38 and have intermediate spacings corresponding to the length of the longitudinal portions 39. In the case of FIGS. 9 and 10 the openings 46 are freely located outside the support member 4 in the bright glowing area 31 of the component 10.

Figure 11:
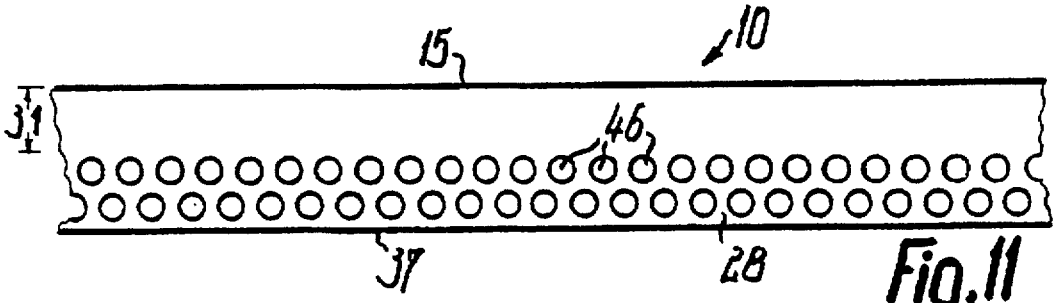

The component 10 according to FIG. 11 has a similar construction to that according to FIG. 8, but the support leg 28 has two or more longitudinal rows of openings 46, the openings 46 of one row being longitudinally displaced with respect to the component 10 by roughly half the intermediate spacing thereof compared with the openings of the other row. In the case of FIG. 9 the said longitudinal rows can be substantially uniformly continuous over the entire length of the component 10. There are no openings in area 31, but its resistance value can be modified in the described way by means of the openings 46, because the area or support leg 28 having the openings 46 forms a parallel resistance for the area 31 and has a much higher resistance value than the area 31.

Figure 12:
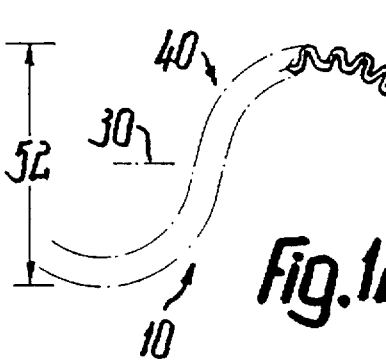

According to FIG. 12 the component 10 has a Line profiling 50, which even without a profiling 40Nis conceivable on a component 10, which is curved by a weaker curvature without permanent deformation corresponding to its curvature about the central axis of the heating field and/or has approximately linear longitudinal portions, which pass into one another via oppositely directed small curvature arcs. The fine profiling 50 is superimposed on the profiling 40 and can be produced simultaneously with or before the latter. The fine profiling 50 is substantially uniform or wavy, its division 51 being much smaller than the corresponding division 29 of the profiling 40. The profile width 53 of the profiling 50 to be measured transversely to the median plane 30 is much smaller than the corresponding profile width 52 of the profiling 40, but much larger than the material thickness 32. For example the profile width 53 in the case of a material thickness 32 between 0.05 and 0.1 mm and a profile width 52 between 2 and 4 mm can be below 2 mm and can be approximately 0.5 to 1 mm. This also applies with respect to the fine division 51, which is approximately the same or up to half smaller than the profile width 53.

Figure 13:
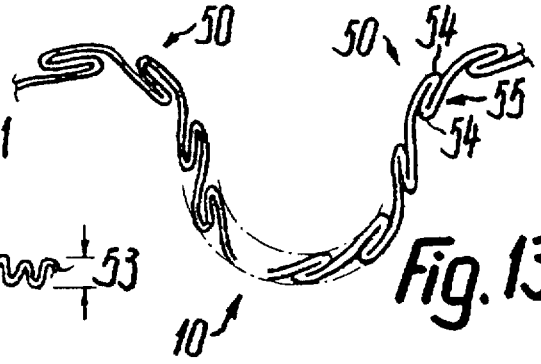

To the left and right in FIG. 13 are shown two different fine profilings 50, which can be provided in successive longitudinal portions of a single component or on separate components. The component 10 is provided with successive, opposing folds 54 of the starting material, which in each case form three-layer portions 55, which are interconnected via a one-layer intermediate portion. By increasing or decreasing the extension or the intermediate spacings of the multilayer portions 55 means are obtained which correspond to the means 45. Whereas to the right in FIG. 13 at least two or all the layers of the portion 55 engage on one another in whole-surface manner, to the left in FIG. 13 they have limited reciprocal spacings, which are only approximately the same as the material thickness. The fine profiling 50 can only be provided in the portion 31, or only in the portion 34, as well as in both portions 31,34 of the cross-section of the component 10. Openings according to FIGS. 8 to 11 can also be provided in the fine profiling 50.

Figure 14:
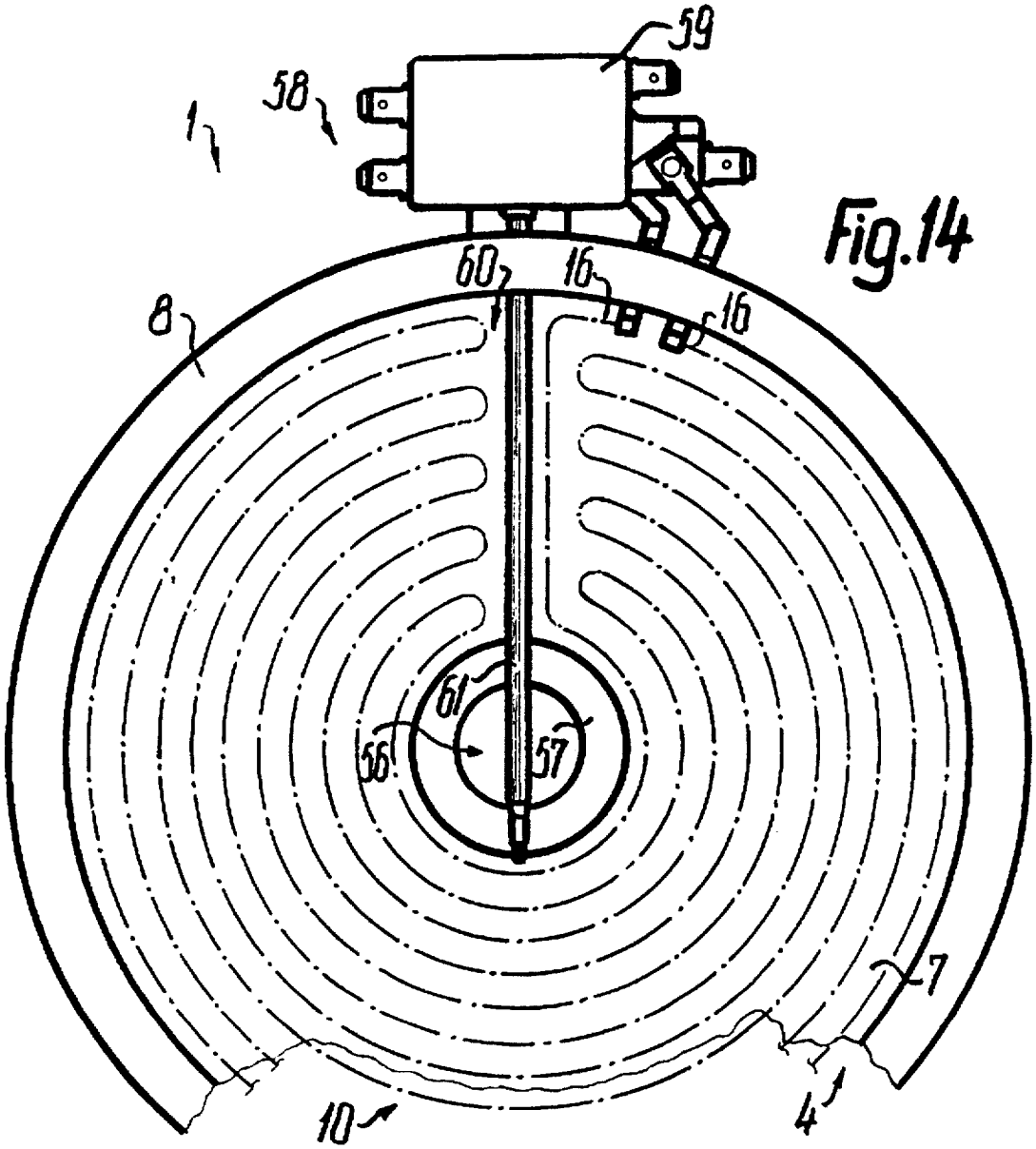
Figure 15:
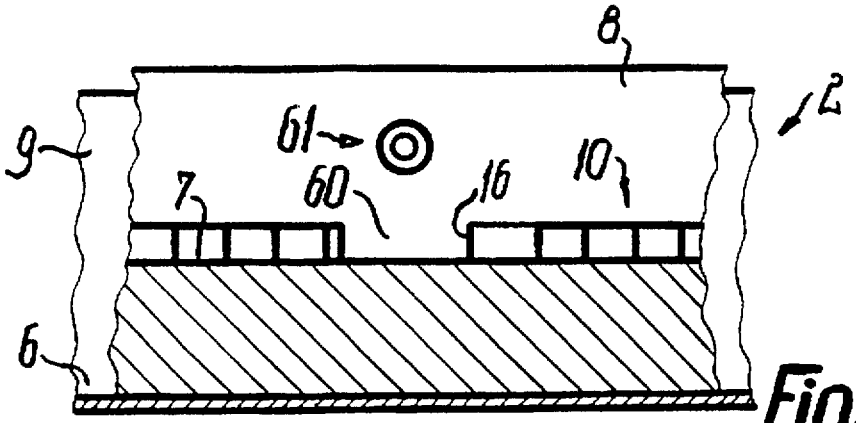

As shown in FIGS. 14 and 15 roughly centrally in the centre or symmetrically to the central axis of the heating field is provided an unheated or resistor-free central zone 56, whose width is smaller than ½ or a ¼ of the width of the heating field and in which there is an annular projection 57 made from the insulating material of the base 7 projecting over the base towards the heating side. The heater 1 is provided with a thermal cutout 58, whose socket 59 receiving electric circuits is so positioned on the outside of the heater 1 or the edge 9 not shown in FIG. 14, that it cannot abut against the cover plate 26. A rod-like temperature sensor 61 projects freely from the socket 59 and traverses the edges 8,9 in substantiall closely adapted openings and projects over the same roughly radially to the heating field. The temperature sensor 61 can e.g. be formed from a metal, exposed outer tube and an inner rod located inside it having different thermal expansion coefficients, the outer tube being substantially rigidly fixed to the socket 59, whereas the inner rod actuates a contact located in the socket 59.

The temperature sensor 61 extends with its free end only roughly into the vicinity of the central zone 56 and can cover facing circumferential areas of the projection 57 or can engage thereon under a slight pretension. In a view on the heating side or plane 21 in the vicinity of the temperature sensor 61 there are no portions of the component 10, but the latter forms in this area an unheated gap 60, whose width is at least 2 or 3 times greater than the cross-sectional width of the sensor 61 in said area. For this purpose the resistor 10 forms concentrically nested curvature portions curved round the central axis of the heating field, which extend over an arc angle of less than 360°, but are uninterrupted on the heating field side facing the free end of the temperature sensor 61.

In the vicinity of the gap 60 two directly adjacent curvature portions pass in one piece into one another via a small curvature arc, so that said curvature arcs form on at least one side of the temperature sensor 61 the lateral flank boundaries of the gap 60. On one side a connecting portion 16 can be guided approxi mately parallel to the temperature sensor 61 up to the innermost curvature portion of the resistor 10 and on this side forms the flank of the gap 60 from which the associated curvature arcs are spaced. Thus, direct reflections of the radiation emanating from the component 10 back to the latter are avoided and also the temperature sensor 61 can be moved closer to the base 7. The socket 59 is so resiliently fixed to the body 2 or to the bottom of the holder 6 with a support arm that the temperature sensor 61 with the socket 59 can elastically perform small deflection movements at right angles to the heating plane at least with respect to parts of the body 2.

All the described constructions, components, units or spaces can be provided once or two or more times, e.g. can switch over several power stages. In place of the central spacing 35 being approximately 1 to 3 times the associated maximum width of the projection 28, said spacing can also be up to twelve times each integral multiple of this width, as a function of the effects to be obtained.

By providing the gap area 60 also the advantage is achieved that the temperature sensor 61 is less exposed to the radiant heat of the heating resistor 10 and therefore thermally responds with a time lag when the associated sections of the heating resistor are set on power and begin with the heating-up phase. This takes place without any shield between the heating resistor and the temperature sensor since the provision of additional components in the vicinity of the gap area 60 is avoided and in this zone the gap area is only bounded by the substantially planar bottom face and the laterally flanking portions of the heating resistor. Because of the mentioned time lag the heating-up phase will not be interrupted too early but will be very effective and powerful.

The gap area 60 continuously extends from inside of rim 8 up to the center zone 56 respective the outer circumference of inner rim 57 without there being any additional shield protecting the temperature sensor 61 against the radiation which from the lateral gap flanks emits in an inclined orientation towards the temperature sensor 61 and therefore arrives at the temperature sensor 61 after a longer path than would be from a radiation source which is located in an axial plane of the temperature sensor 61 oriented perpendicular to the heating plane 21. As will be apparent from FIG. 15, the temperature sensor 61 is displaced toward the heating resistor 10 or the heating plane 21 as seen by comparing FIGS. 1 and 15. The temperature sensor 61 is located in an axial plane parallel to the heating plane 21 but correspondingly offset with respect to edge 15 of heating resistor 10. Over its entire length the gap 60 has substantially constant width extension and freely opposes the sensor 61 without any intermediate shield.

In the following, further essential features and combinations of features of the invention will be explained.

According to the invention, the heater defining said heating field 20 comprises a base 2 providing at least one counter face 19 in the vicinity of said heating field 20, a plurality of assembling members 10, 17, 28, 38, 39 defining an assembled state for heating operation and a non-assembled state, said assembling members 10, 17, 28, 38, 39 including at least one structural member 10, a supporting structure 17, and at least one support leg 28, at least one of said assembling members 10, 17, 28, 38, 39 having remote side faces 12, 13, 43, 44, lateral edge faces 41 and a vertex end 37, said edge faces defining lateral edge planes and median leg planes 30 being defined between said side faces 12, 13, 43, 44 in the assembled state, said vertex end 37 being provided at an end of an overall linear longitudinal extension of said support leg 28 defining a longitudinal leg direction, at least one of said assembling members 10, 17, 28 including first length sections 38 repeatedly followed by second length sections 39, at least one of said assembling members 10, 17, 28, 38, 39 defining a length extension transverse to said longitudinal leg direction, at least one of said assembling members 10, 17, 28, 38, 39 being finished from a basic raw material defining a basic cross-section, a basic material thickness, and a basic length extension substantially different from said length extension providing an operational length extension, cross-sections being defined including at least one longitudinal cross-section parallel to said longitudinal leg direction and at least one transverse cross-section transverse to said longitudinal leg direction, in at least one of said cross-sections at least one of said assembling members 10, 17, 28, 38, 39 defining a material thickness 32 between said side faces 12, 13, 43, 44, at least one of said side faces 12, 13, 43, 44 providing a support flank 43, 44 for supporting at least one of said assembling members 10, 17, 28, 38, 39 against said counter face 19 in a supporting area provided at a distance from said vertex end 37 of at least said material thickness 32, whereby in the non-assembled state of at least one of said assembling members 10, 17, 28, 38, 39 at least one premanufactured profile 40, 50 is associated with at least one of said support flank 43, 44 along said longitudinal leg direction and substantially between said lateral edge planes of said support leg 28, said profile 40, 50 providing profile sections, in at least one of said cross-sections at least one of said profile sections extending transverse to at least one of said median leg planes 30, at least one of said support leg 28 extending only over a partial section 33 of said length extension of at least one of said structural member 10, said supporting structure 17, said first length section 38 and said second length section 39.

At least one of said profile 40, 50 providing at least one of means for modifying at least one strength including a buckling strength of said support leg 28 increased with respect to pressure loads parallel to said longitudinal leg direction, support flanks 43, 44 for a support of at least one of said assembling members 10, 17, 28, 38, 39, said support extending to a distance from said vertex end 37 and said edge faces 41, a guide profile for a frictional engagement and slideable guidance of at least one of said assembling members 10, 17, 28, 38, 39 on said counter face 19, a prefabricated configuration 40, 50 diverging from said basic cross-section, a band profiling formed by permanent and non-returning deformation of said basic raw material, an elastically stretchable compensation profile for balancing tensions, a thermal coupling profile, a material thickness substantially equal to said basic material thickness, a stiffening of at least one of said assembling members 10, 17, 28, 38, 39, an extension of a profile deformation substantially over entirely said raw material cross-section of at least one of said assembling members 10, 17, 28, 38, 39, and an electrically resistance-active portion of at least one of said assembling members 10, 17, 28, 38, 39, at least one of said profile 40, 50 being provided in substantially rigid stiff connection with at least one of said assembling members 10, 17, 28, 38, 39.

In the vicinity of said profile 40, 50 and in at least one of said longitudinal cross-section at least one of said side faces 12, 13, 43, 44 is substantially linear and linearly emanating from said vertex end 37. In the vicinity of at least one lateral edge boundary 41 at least one of said side faces 43, 44 is oriented at an angle to said median leg plane 30 interconnecting mutually remote flank portions of said edge boundary 41, in at least one of said cross-sections at least one of said side faces 12, 13 or support flanks 43, 44 being substantially at least one of uninterrupted, linear, and free of steps over an entire extension of at least one of said assembling members 10, 17, 28, 38, 39, said extension being parallel to said cross-section. At least one of said profiles 40, 50 is constructed in one piece with at least one of said assembling members 10, 17, 28, 38, 39, at least one of said support leg 28 providing a projection, and at least one of said edge faces 41 connecting to a member edge 14 of said structural member 10, said member edge 14 being longer than said edge face 41.

In at least one of said cross-sections and at least over part of said longitudinal leg extension 34 at least one of said support leg 28 provides leg sections 24 mutually oriented at an angle, in at least one of said cross-sections, at least one of said assembling members 10, 17, 28, 38, 39 having at least one of a curvature 23, and mutually angled leg sections 24, in a transition portion connecting said support leg 28 to at least one of said supporting structure 17, and said structural member 10, at least one of said assembling members 10, 17, 28, 38, 39 being formed from said basic raw material providing a flat material strip, at least one of said basic cross-section, and said operational cross-sections being oblong, flat and substantially rectangular. In at least one of said cross-sections and over most of said longitudinal leg extension at least one of said profile 40, 50 has profile extensions in two mutually rectangular directions, said profile extensions being multiply greater than said material thickness 32 of said basic raw material, in at least one of said cross-sections and substantially entirely over said longitudinal leg extension 34 at least one of said profile 40, 50 providing at least one curvature 23 of at least one of said side faces 12, 13, 43, 44, said transverse cross-section of at least one of said assembling members 10, 17, 28, 38, 39 being extendable substantially parallel to said length extension, at least one of said assembling member 10, 17, 28, 38, 39 being curved to provide a longitudinally open channel, at least one of said assembling members 10, 17, 28, 38, 39 being fastened to said base 2 against lifting off motions substantially exclusively by frictional non-positive engagement of said at least one support flank 43, 44.

In said longitudinal leg direction at least one of said structural member 10 defines a residual height extension 31, said longitudinal leg extension 34 of at least one of said support leg 28 being greater than said residual height extension 31, at least one of said support leg 28 being tapered towards said vertex end 37 with respect to a width extension 33, said vertex end 37 of at least one of said support leg 28 providing a plug tip edge projecting transverse to said operational length extension, in a view parallel to said longitudinal leg direction at least one of said support leg 28 being provided substantially within outer boundaries 12, 13 of an associated one of said length sections 38 of said structural member 10. Juxtaposed support legs 28 have a spacing 35 from one another of substantially 2 to 4 times greater than a maximum width extension 33 of at least one of said support leg 28.

Substantially at a common point of said longitudinal leg extension 34, connecting to both said lateral edge faces 41 of at least one of said support leg 28 and between juxtaposed support legs 28 said structural member 10 and said supporting structure 17 have continuously uninterrupted and step-free longitudinal edge faces 14 oriented transverse to said longitudinal leg direction, in a stress-relieved condition of at least one of said assembling members 10, 17, 28, 38, 39 substantially all said edge faces 14 being located substantially in a common plane, in a planar lay-out at least one of said lateral edge faces 41 of at least one of said support leg 28 being substantially step-free and substantially all said support legs 28 of at least one of said supporting structure 17 being of substantially identical contour shape. A plurality of said at least one support leg 28 is distributed along an imaginary longitudinal median line 30 parallel to said basic length extension, within at least one subplurality of said plurality and in said operational length extension said support legs 28 having different profile shapes and different orientations with respect to said median line 30, in a linearly stress-free expanded condition of at least one of said assembling members 10, 17, 28, 38, 39 said vertex ends 37 of said support legs 28 being located in planes mutually differently oriented, in a view parallel to said longitudinal leg direction said support legs 28 being at least one of differently, and oppositely curved, in said expanded condition said operational length extension being shorter than said basic length extension.

Said at least one support leg 28 provides juxtaposed support legs 28 and cutouts between said juxtaposed support legs 28 in said supporting structure 17, in a planar lay-out of said supporting structure 17 said support leg 28 and said cutouts having substantially same contour shapes and sizes, at least one of said support leg 28 extending uninterrupted entirely over one of said second length sections 39 of said structural member 10, said second length section 39 being between at least as long and twice longer than said longitudinal leg extension 34. At least one of said support leg 28 extends over between more than a ¼ and substantially entirely said basic length extension and said operational length extension of said structural member 10.

Means 45 are provided for modifying an electrical resistance of said structural member 10, said means including at least one of openings 46 distributed in a grid distribution and bounded by said support leg 28 over an entire circumference, and material foldings of said basic raw material. At least one of said profiles provides a micro profile 50 of similar profile units defining pitch spacings 51 and interconnected along a profile pitch of said pitch spacings 51, said pitch spacings 51 being between at the most 20 and 4 times said material thickness 32 and less than between 3 and 0.4 mm. Said at least one profile 40, 50 provides at least two first and second profiles 40, 50, said second profile 50 being coarser than said first profile 40 and having a pitch division of a profile pitch multiply smaller than a corresponding pitch division 29 of said first profile 40, said second profile 50 superposing and being provided within said first profile 40, said second profile 50 being at least partly at least one of uniformly parallel to said length extension, of corrugated wave shape, and scaly with substantially interengaging and superimposed profile legs.

Only over a part of said longitudinal leg extension 34 at least one of said support leg 28 provides a resistance-active portion directly engaging said at least one counter face 19 so as to be secured against lifting off at least by friction. At least one of said support leg 28 is traversed by a plurality of openings 46 distributed in at least one grid distribution in at least one of said longitudinal leg direction, and said length extension. Fields 47 of narrowly grid-distributed openings 46 are provided in at least one of said assembling members 10, 17, 28, 38, 39, said fields 47 being mutually spaced parallel to said length extension.

Holding means are provided for substantially positively holding at least one of said assembling members 10, 17, 28, 38, 39, said first and second length sections 38, 39 being at least partly free of screw-winding curvature and providing substantially linearly and alternately grid-distributed operationally resistance-active first and second length sections 38, 39 for operation in operating states including an initial power consumption in a heating up phase, a substantially constant heating phase at a permanent operating power and a cooling down phase at a shut-off state of power supply, in said operating states said length sections 38, 39 having specific operational parameters including electrically active resistance values, resistance-active cross-sections, thermal storage capacities and operating temperatures, wherein in at least one of said operating states at least one of said operational parameters of said interconnected resistance-active length sections 38, 39 are mutually different.

Said first and second length sections 38, 39 are distributed along an imaginary longitudinal median line 30, said first and second length sections 38, 39 being reciprocally displaced transverse to said median line 30, said second length sections 39 being provided with at least one of said support leg 28 and said first length sections 38 being provided between juxtaposed said support legs 28. At least a partial plurality of said length sections 38, 39 of at least one of said assembling members 10, 17, 28 defines a layer plane 21, in a view transverse to said layer plane 21 at least one of said length sections 38, 39 being curved, at least one of said length sections 38, 39 having mutually angularly oriented leg portions 23, 24 diverging at an acute angle, in said view said length sections 38, 39 filling a band width extension 52, 53, said operational length extension of at least one of said length sections 38, 39 being substantially greater than said band width extension, said operational length extension being parallel to said layer plane 21.

At least one of said first length section 38 is substantially between as long and longer than at least one of said second length section 39, in a layer field at least one of said assembling members 10, 17, 28, 38, 39 providing spacedly juxtaposed longitudinal winding sections longer than said length extension of at least one of said length sections 38, 39, in the vicinity of at least one of said length sections 38, 39 at least one of said structural member 10 being opposedly curved, at least one of said length sections 38, 39 having at least one curve 23 and extending substantially over between one and more than one full wave configuration 29 of at least one of said profiles 40, 50. In the vicinity of said length sections 38, 39 at least one of said assembling members 10, 17, 28 is permanently curved in alternating configurations, at least one of said assembling members 10, 17, 28, 38, 39 being curved transversely to an oblong extension 31, 34 of said basic cross-section oriented transverse to said length extension of said assembling members 10, 17, 28, 38, 39, at least one of said configurations and said profile 40, 50 providing at least a section of at least one of a corrugation, a meander, a toothing, a sine wave, a U-profile, and a V-profile.

With said transverse cross-section at least one of said assembling members 10, 17, 28, 38, 39 and said basic raw material provides oblong flat cross-sections, at least two of said assembling members 10, 17, 28, 38, 39 providing partitional segments by being commonly finished in one piece from said basic raw material providing a flat web strip, at least one of said assembling members 10, 17, 28, 38, 39 providing remote longitudinal edge faces 14, 15 or 37 substantially parallel with respect to each other and connecting said side faces 12, 13, 43, 44, at least one of said longitudinal edge faces 14, 15 extending substantially continuously uninterrupted over said length extension in a single plane. At least one of said longitudinal edge faces 14, 37 provides a toothing, in a cross-section transverse to said length extension said second length section 39 having a larger extension transverse to at least one of said longitudinal edge face 14, 15, 37 than said first length section 38, transverse to said layer plane 21 at least one of said assembling members 10, 17, 28, 38, 39 having cross-sectional extensions between at least as large and larger than cross-sectional extensions parallel to said layer plane 21, in said longitudinal cross-section being provided a common standing orientation of said structural member 10 and at least one of said support leg 28 providing a plate, in at least one of said cross-sections and between said lateral edge faces 41 said plate having substantially full material flattened cross-sections over at least one of entirely said length extension, and a common overall height extension 31, 34 of said assembling members 10, 17, 28, 38, 39.

At least one of said assembling members 10, 17, 28, 38, 39 is at least partly freely exposed with respect to said base 2 providing at least one support 4, at least one of said assembling members 10, 17, 28, 38, 39 being thermally coupled to said support 4 via said second length sections 39 spacedly distributed over said length extension, at least one of said assembling members 10, 17, 28, 38, 39 being provided in one piece between extension ends 16 of said lenght extension, a plurality of said first and second length sections 38, 39 having spacings from said extension ends 16, at least one of said support leg 28 forming at least one of said second length section 39, in said assembled state and said non-assembled state at least one of said assembling members 10, 17, 28, 38, 39 being inherently substantially stiffer against resilient bending deformation transverse to said heating field 20 than parallel to said heating field 20.

Distributed over substantially entirely said length extension at least one of said assembling members 10, 17, 28, 38, 39 is directly fixedly connected to at least one support of said base 2, in the vicinity of said second length sections 39 at least one of said support leg 28 being pressed into said support 4 providing a higher pressure resiliency than said support leg 28, at least one of said support leg 28 providing retaining sections distributed along said length extension and resiliently stressed at least one of towards tilted orientations tilted transverse to said length extension of said structural member 10, and parallel to said length extensionagainst said counter face 19 provided by an insulation 3, said support 4 being elastic in a back springing manner and substantially unsinterable under all occuring operational conditions, said supporting structure 17 providing a shaping tool for substantially entirely manufacturing at least one closely adapted reception depression substantially entirely bounded by said counter face 19 in one piece on at least one of a depression bottom, and depression flanks.

Control means are provided for operating at least one of said first and second length sections 38, 39 at a visible thermally radiating glowing over an oblong curved and substantially planar light line, said control means being provided for longitudinally expanding said light line in a heating up phase, in said heating up phase said glowing initially starting from a substantially punctiform illumination at a length center of at least one of said length sections 38, 39 and steadily expanding in opposite directions so as to provide said light line, means being provided for reducing flow of current through said longitudinal cross-section of at least one of said support leg 28 with respect to a remaining cross-section of said structural member 10, said remaining cross-section being a planar continuation of said longitudinal cross-section. Also said control means are provided for operating at least one of said first length sections 38 in said constant heating phase at a higher operating temperature than at least one of said second length section 39, said first length section 38 longitudinally directly connecting to at least one of said second length section 39, thereby providing an oblong grid pattern of alternately following said first and second length sections 38, 39, said grid pattern extending along said imaginary longitudinal median line 30 providing successive line zones of at least one of alternating different first and second temperatures, and alternating different illumination brightnesses, said control means being provided for in said heating up phase illuminating at least one of said first length sections 38 prior to at least one of said second length sections 39.

Whole number multiples of said material thickness 32 are defined, said distance being defined by one of said whole number multiples of said material thickness 32, said whole numbers including each number between 20 and 80, at least one of said support flank 43, 44 having an overall areal extension and continuously engaging said counter face 19 over substantially entirely said areal extension closely in full-surface manner, said material thickness 32 being at the most between 0.1 mm and a 20th to 50th part of said longitudinal extension. At least one of said supporting structure 17 and said support leg 28 is substantially uniformly distributed over at least one of said heating field 20 and said structural member 10, said counter face 19 positively securing at least one of said assembling members 10, 17, 28, 38, 39 over most of said length extension substantially free of motion play against motions in substantially all directions parallel to said heating field 20 and against inverse transverse tilting motions defining directions, said directions including inverse longitudinal directions parallel to said length extension and inverse transverse directions transverse to said length extension.

Said at least one temperature sensor 61 is provided in an unheated area 60 of said heating field 20, in a view transverse to said heating field 20 said structural member 10 being set back to provide a narrow gap 60 substantially parallel to a rod extension of at least one of said temperature sensor 61, at least one of said temperature sensor 61 extending only over part of a width extension of said heating field 20 distributingly occupied with at least one of said assembling members 10, 17, 28, 38, 39, in a longitudinal extension of said at least one unheated area 60 and substantially beyond at least one of said temperature sensor 61 said at least one assembling member 10, 17, 28, 38, 39 providing a heated area of said heating field 20.

We claim:

1. A heater unit comprising:

a base body defining a thermal outlet and including a support bottom made from electrically insulating material, said support bottom defining a central axis oriented perpendicular to said support bottom, on a heating side (20) said support bottom including a substantially planar bottom surface;

a heating resistor including wire-like elongated radiant resistor portions directly engaging said support bottom on said heating side in the vicinity of said substantially planar bottom surface, said resistor portions being curved around said central axis, said heating resistor defining a heating field, a center zone and a heating plane substantially parallel to said support bottom;

said radiant resistor portions defining a gap area above said support bottom and between said resistor portions when seen in a view perpendicular to said heating plane, said radiant resistor portions providing lateral flank boundaries of said gap area; and, a rod-shaped temperature sensor freely projecting over said heating side substantially parallel to and in the vicinity of said gap area when seen in said view perpendicular to said heating plane, wherein said gap area is free from said radiant resistor portions, said gap area being solely provided by said substantially planar bottom surface.

2. The heater unit according to claim 1, wherein said temperature sensor is displaced towards said radiant resistor portions and said thermal outlet.

3. The heater according to claim 1, wherein said temperature sensor is located in a sensor plane substantially parallel to said heating plane, said sensor plane being displaced towards said thermal outlet with respect to said heating plane.

4. The heater unit according to claim 1, wherein said radiant resistor portions are made from a flat band having flat cross-sections, said flat cross-sections (11) being oriented transverse to said heating plane.

5. The heater unit according to claim 4, wherein said flat band is corrugated.

6. The heater unit according to claim 4, wherein said flat band includes at least one support leg directly inserted into said support bottom, said support leg being at least partly an inherently stiff pre-curved profile supportingly engaging said support bottom.

7. The heater unit according to claim 1, wherein said temperature sensor is oriented substantially radially with respect to said heating field.

8. The heater unit according to claim 1, wherein said temperature sensor comprises a freely exposed outer sensor member and a sensing member located inside said outer sensor member.

9. The heater unit according to claim 1, wherein said temperature sensor freely extends from a base socket connected to said base body, substantially outside of at least one of said heating field and said thermal outlet.

10. The heater unit according to claim 1, wherein said temperature sensor comprises an outer sensor member made from metallic material.

11. The heater unit according to claim 1, wherein said temperature sensor comprises a radiation reflector.

12. The heater unit according to claim 1, further comprising at least one jacket bounding said thermal outlet and said heating field, said temperature sensor traversing said at least one jacket in the vicinity of a passage opening.

13. The heater unit according to claim 1, further comprising at least one jacket bounding said thermal outlet and said heating field, said temperature sensor being fixedly connected to said at least one bounding jacket.

14. The heater unit according to claim 1, wherein said temperature sensor extends substantially up to said center zone.

15. The heater unit according to claim 1, wherein within said heating field, said temperature sensor and said base body reciprocally support one another.

16. The heater unit according to claim 1, further comprising a protrusion within said heating field, said temperature sensor and said protrusion touching each other.

17. The heater unit according to claim 1, wherein said heating field defines an over-all width extension, said temperature sensor only partly extending over said width extension.

18. The heater unit according to claim 1, wherein said temperature sensor extends only substantially up to said center zone.

19. The heater unit according to claim 1, wherein on said heating side said base body comprises a front surface including said bottom surface and associated with said heating field and said thermal outlet, said temperature sensor spacedly but closely opposing said front surface to thereby advance a flat extension defined by said heater unit.

20. The heater unit according to claim 1, wherein within said heating field said temperature sensor contacts said base body under a pretension.

21. The heater unit according to claim 20, wherein said pretension acts transversely to said heating plane.

22. The heater unit according to claim 1, wherein said base body comprises a protrusion within said heating field, said temperature sensor covering said protrusion.

23. The heater unit according to claim 22, wherein said protrusion comprises remote circumferential areas, said temperature sensor covering said circumferential areas.

24. The heater unit according to claim 1, wherein said base body comprises an annular protrusion within said heating field and in the vicinity of said temperature sensor.

25. The heater unit according to claim 1, wherein within said heating field said temperature sensor is connected to said base body by said insulating material.

26. The heater unit according to claim 1, further comprising:

said resistor portions emitting a thermal radiation defining a radiation output oriented through said thermal outlet;

reflecting locations for directly reflecting the thermal radiation back to said resistor portions; and, said temperature sensor being located outside said reflecting locations to thereby avoid reflecting the thermal radiation back to said resistor portions while said temperature sensor is exposed to the thermal radiation.

27. The heater unit according to claim 1, wherein said heating resistor is substantially uniformly distributed over said heating field, said resistor portions including juxtaposed resistor length sections, said gap area and said center zone defining a non-heated area of said heating field.

28. The heater unit according to claim 1, wherein said temperature sensor defines a cross-sectional sensor width diameter and said gap area defines a gap width extension, said gap width extension being at least two to three times bigger than said diameter.

29. The heater unit according to claim 1, wherein said resistor portions comprise first length arcuate sections curved about said center axis and at least one second length section, at least one of said first length sections and said second length section providing a lateral flank boundary laterally bounding said gap area.

30. The heater unit according to claim 29, wherein said first length sections include juxtaposed length sections interconnected in one part by curved parts, said curved parts defining said flank boundary on at least one side of said temperature sensor.

* * * * *